United States Patent [19]

Taylor et al.

[11] Patent Number: 5,073,415

[45] Date of Patent: Dec. 17, 1991

[54] APPARATUS FOR COATING AN IRON BASED METAL WITH A LIQUID PROTECTIVE METAL AND METHOD

[75] Inventors: Thomas A. Taylor, Indianapolis; Robert C. Tucker, Jr., Brownsburg, both of Ind.

[73] Assignee: Union Carbide Coatings Service Technology Corporation, Danbury, Conn.

[21] Appl. No.: 442,462

[22] Filed: Nov. 30, 1989

Related U.S. Application Data

[63] Continuation of Ser. No. 213,270, Jun. 28, 1988, abandoned, which is a continuation of Ser. No. 863,448, May 12, 1986, abandoned.

[51] Int. Cl.[5] ..... B05D 1/18

[52] U.S. Cl. ..... 427/433; 118/423; 118/419; 427/360

[58] Field of Search ..... 427/433, 360; 118/423, 118/419

[56] References Cited

U.S. PATENT DOCUMENTS

| | | | |
|---|---|---|---|
| 2,797,476 | 7/1957 | Sendzimic | 427/433 |
| 2,926,103 | 2/1960 | Brick | 427/360 |
| 4,351,854 | 9/1982 | Pelerin | 427/433 |

FOREIGN PATENT DOCUMENTS

| | | | |
|---|---|---|---|
| 1227754 | 10/1966 | Fed. Rep. of Germany | 427/360 |

OTHER PUBLICATIONS

"The Making, Shaping and Treating of Steel", 10th ed., 1985, Assn. of Iron & Steel Engineers/U.S. Steel Corp.

*Primary Examiner*—Sam Silverberg
*Attorney, Agent, or Firm*—Eugene Lieberstein

[57] ABSTRACT

In processes in which protective metal coating materials are applied to iron-based substrates in the form of liquid films which are then solidified by cooling, the metal coating can be contacted with a roll such as a tower roll, conveyor roll or guide roll, while the coating material is capable of transfer, by the use of a roll having an exterior ceramic barrier or surface having a thickness of at least about 20 microns whereby the surface of the coated substrate is not unduly adversely affected.

28 Claims, 3 Drawing Sheets

FIG. 2
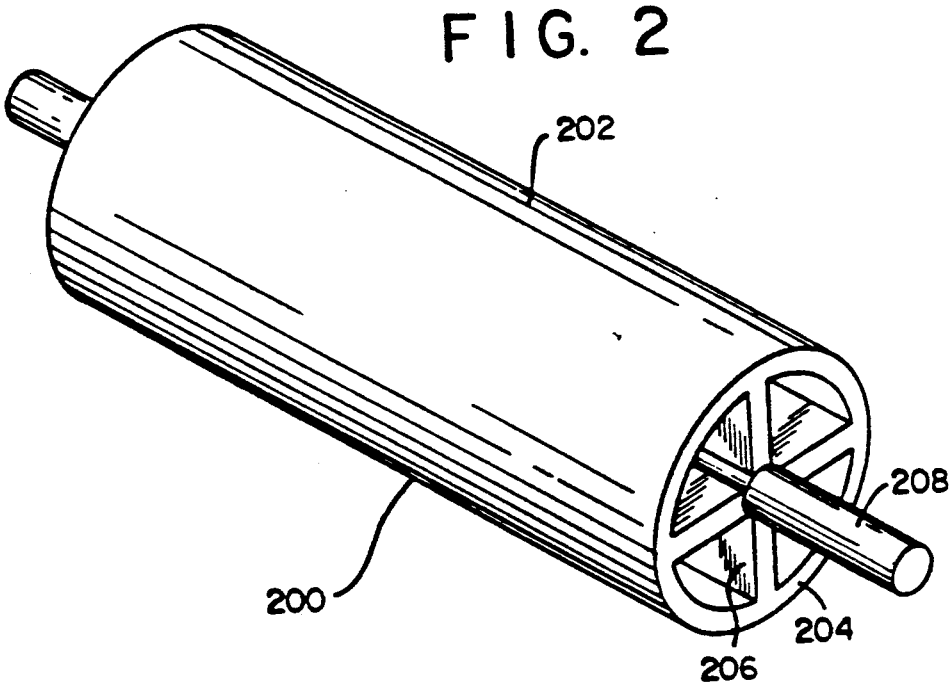
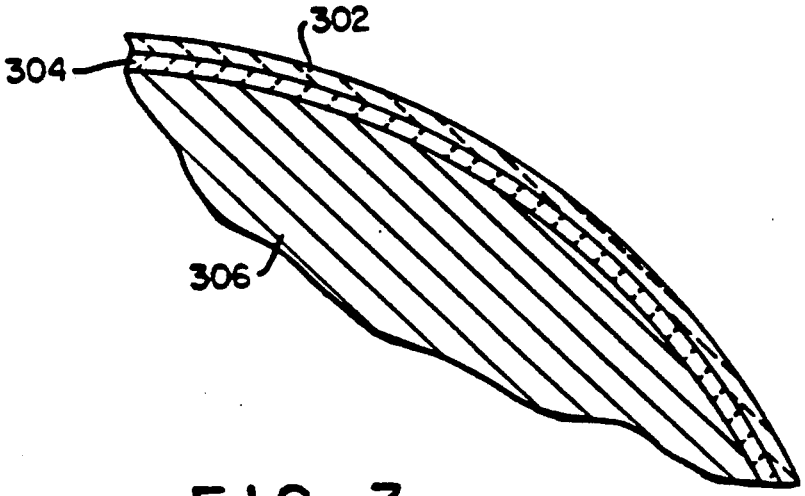
FIG. 3

APPARATUS FOR COATING AN IRON BASED METAL WITH A LIQUID PROTECTIVE METAL AND METHOD

This application is a continuation of prior U.S. application Ser. No. 213,270, filing date June 28, 1988, now abandoned, which is a continuation of application Ser. No. 863,448, filing date May 12, 1986, now abandoned.

This invention pertains to apparatus and processes for protective coating of iron-containing metals such as processes and apparatus for the continuous hot-dip galvanizing of iron-based sheet metal.

The corrosion of iron-based metals can be mitigated by coating the metal with a protective metal coating material, i.e., an anodic or cathodic metal such as zinc, tin, aluminum, lead, or mixtures or alloys thereof. Anodic materials such as zinc are sacrificial and thereby provide corrosion protection to the underlying substrate whereas cathodic materials typically serve as barrier layers. The deposition of these matals on an iron-based metal substrate is herein referred to as a "protective metal coating process". The protective metal coating process can be conducted by immersing the substrate into a vessel containing the molten protective metal coating material for the coating or by spraying or otherwise applying a liquid film of the protective metal coating material on the substrate. These types of processes are herein referred to as "liquid film coating" processes.

Galvanizing (zinc coating) is a widely practiced process for liquid film coating and is conventionally practiced by immersing the metal substrate into a vessel containing molten zinc and then removing the metal substrate from the vessel to effect the coating ("hot-dip" process). Typically in continuous processes for galvanizing sheet metal, the sheet metal is removed vertically from the molten zinc and passed over a tower roll which enables the movement of the sheet to be redirected. In these processes, the tower roll may be positioned about 10 to 80 meters above the vessel containing the molten zinc. This distance is selected on the basis of the time required, under the rate of movement of the sheet, for the zinc coating to solidify sufficiently so that the zinc does not transfer to the tower roll. In general, the zinc or other protective metal coating material contacting the roll may be molten, semi-solid, or solid. Even when solid, but while still hot, the protective metal coating material can transfer to a roll since the full strength of the coating has not developed. That is, the coating may be characterized as being in a plastic state and is subject to being transferred to a roll surface.

Further information about applying protective metal coatings can be found in "THE MAKING, SHAPING AND TREATING OF STEEL", Tenth Edition, 1985, Association of Iron and Steel Engineers/United States Steel Corporation, herein incorporated by reference.

With the current emphasis on corrosion resistance in the automotive and other industries, protective metal coating processes, especially galvanizing, are sought-after treatments for iron-based materials for fabrication. In many such applications the protective metal coating must be painted and the resulting finish must be very smooth to meet the approval of the ultimate consumer. Unfortunately, galvanized finishes are characterized by crystal structures that provide large relief patterns, referred to as "spangles", which are difficult to paint without their crystal pattern showing through the paint.

Recently a process modification referred to as galvannealing has found acceptance in providing galvanized coatings having a substantial absence of spangles as well as superior mechanical properties. In the galvannealing process, the zinc-coated substrate exiting the molten zinc bath is heated for a sufficient time to enable a zinc-iron alloy to be formed. The alloy has a relatively uniform matte finish, that can readily be painted, providing a finish of an acceptable quality to a discriminating consumer.

Difficulties exist when adapting the conventional galvanizing processes to utilize the galvannealing technique. As stated earlier, the distance between the vessel containing the molten zinc and the tower roll is selected such that the zinc coating is solidified sufficiently prior to the contact of the sheet with the tower roll that a transfer of the zinc to the tower roll surface does not occur. The installation of an intervening galvannealing unit results in shortening the distance that cooling can occur before the sheet metal contacts the tower roll. If the normal production speed is maintained, then the zinc does not sufficiently solidify prior to contacting the tower roll. This contact has been found to adversely affect the quality of the finish. For instance, deposits of zinc develop on the tower roll and cause a marring of the sheet metal surface or even a perforation of the sheet surface.

Proposals to eliminate the deposits on the tower roll have included cooling the tower roll, externally with water or internally with water or a glycol solution. By cooling the tower roll, it was thought that the cooler surface would have less affinity for the zinc and that the chilling would result in the spalling of any transferred zinc particles from the roll. This procedure proved to be unsuccessful. Pick-up still occurred, and variations in the temperature over the surface of the roll resulted, in some instances, in buckling or warping of the sheet metal. Direct spraying of the galvanized sheet metal also proved to be unsuccessful due to temperature differentials that cause the sheet metal to buckle or warp. Another proposal has been to scrape the surface of the tower roll with a blade to remove any accumulated zinc. This approach has not been effective in adequately removing the zinc and the problems continue. It is also possible to reduce the rate of production of the galvanized metal or to modify the equipment by further elevating the tower roll to allow for sufficient cooling to prevent zinc transfer. The first alternative is unattractive due to the reduced production capacity and the latter alternative suffers from substantial capital costs in revamping existing facilities.

The most common practice has been the periodic maintenance and/or replacement of tower rolls. However, because of the location of the tower rolls and the heat in the vicinity of the tower rolls due to their location in the mill, this procedure is difficult, time consuming, and results in lost production and spotty quality.

SUMMARY OF THE INVENTION

By this invention processes and apparatus have been provided that enable iron-based metals having protective metal coatings applied thereon by a liquid film coating technique to contact rolls such as tower rolls, conveyor rolls, guide rolls and the like while the protective metal coating material has not yet cooled or solidified sufficiently to avoid transfer of the protective metal coating material to ordinary roll surfaces without transfer of material so that acceptable finishes can be obtained i.e., undue amounts of the protective metal coatings do not transfer to the rolls. Accordingly, conventional galvanizing mills can be modified to include a galvannealing unit yet still use the existing tower roll configuration and production rates when using this invention. This invention is also useful in other types of mills.

In accordance with this invention the rolls to contact the protective metal coating material, comprise a body defining a surface for contact with the protective metal coated metal which body is adapted to be rotated around its axis wherein at least that portion of the surface intended to contact the metal is a ceramic surface or barrier system. The ceramic surface or barrier is a refractory oxide and has a thickness of at least about 20 microns. Advantageously, the roll can be used in apparatus for the liquid film coating of sheet metal in a continuous manner.

This invention also relates to processes for the liquid film coating of metal in which the metal is contacted with molten protective metal coating material to provide a coating of the protective metal coating material on the metal, and thereafter contacting the metal with a roll in accordance with this invention for purposes of directing the metal in a desired direction, said contact occurring while the protective metal coating is capable of transfer.

In another aspect of the invention, the protective metal coated material contacts a continuous conveyor and the contact surface of the conveyer is a ceramic surface system. The conveyor may comprise narrow strips that are substantially perpendicular to the movement of the conveyor which strips are movable in respect to one another or a loose woven mesh.

As stated above, the protective metal coating may be capable of transfer to a surface when it is in a liquid or even solid state, i.e. when it has not yet cooled or solidified sufficiently or it can be said that the protective metal coating is in a viscous or plastic state.

The mechanism of transfer of the protective metal coating material to the tower roll is not well understood and is probably dependent on the specific composition of both the coating and the surface of the tower roll. The temperature of the protective metal coating material in particular is very important. The protective metal coating material, as it first comes in contact with the tower roll surface is usually below its solidus temperature, but may be between the solidus and liquidus temperatures in some instances; i.e., part of the material may be solid and part liquid. In either event, the material is in a highly plastic or viscous state and is easily transferred to the roll surface. Transfer may occur as the result of either adhesion or abrasion. Adhesive transfer occurs when a chemical bond forms between the protective metal coating and the tower roll surface which is stronger than the internal cohesive strength of the coating or the bond of the coating to its substrate. Abrasive transfer may occur when an asperity, harder than the protective metal coating, scoops out coating material. The tendency for any of these mechanisms to operate diminishes as the temperature of the coating material decreases because the strength of the coating increases with decreasing temperature. Once a small amount of protective metal coating material has transferred to the tower roll surface, additional material may build-up on this transferred material, eventually forming large lumps which may damage the coated sheet material.

DETAILED DESCRIPTION OF THE INVENTION

The rolls of this invention can be used in a variety of applications in a number of protective metal coating processes. The liquid film coating processes include hot-dip processes and spraying processes. In hot dip processes, the metal to be treated is immersed into a vessel containing molten protective metal coating material and is withdrawn in a generally upward direction. Most frequently in continuous processes, the metal is withdrawn vertically and passes to a tower roll. The metal is then redirected and passes over various rolls in a further cooling section after which it may be subjected to further treatments or packaged for use.

Another type of hot-dip process involves removing the metal from the vessel to a substantially horizontal conveyor for transporting and cooling. This process is often used when applying the protective metal coating material to pieces of metal rather than continuous sheets of metal. The conveyor system may comprise rollers in accordance with this invention or a continuous conveyor in accordance with this invention.

In the spraying process, the molten protective metal coating material is sprayed to contact the metal substrate. Often when using the spraying process, the protective metal coating material solidifies immediately upon contact with the cooler metal substrate. However, in such situation, this invention can still be useful if the protective metal coating material is capable of transfer.

The most commonly used protective metal coating materials include zinc, aluminum, aluminum-zinc alloy, and aluminum-silicon alloy although tin, terne metal (lead and tin), copper and copper alloys can be applied using the liquid film coating technique. The metal substrate is an iron-based metal and is often cast iron or steel and has a sufficiently high softening temperature that it is not adversely affected by the temperatures required for the application of the molten protective metal coating material. The form of the metal substrate may vary depending upon the ultimate need. For instance, the substrate may be in the form of a continuous sheet, wire or screen or it could be in the form of the final product such as a molded part or a cast article.

The protective metal coating material for the application of the liquid film to the metal substrate is at a temperature to provide the desired rheological properties for forming a coating of the desired thickness. The temperature range will vary depending upon the nature of the protective metal coating material. However, temperatures should be avoided at which the metal substrate becomes unduly adversely affected. The nature of the protective metal coating material can also be affected by the time of contact with the molten protective metal coating material in a hot-dip process.

The cooled substrate may be further heat treated by maintaining the substrate in a heating zone under temperatures for chemical interaction or recrystallization. For instance, the heating in galvannealing permits chemical interactions to occur between zinc and iron. The temperature and duration of the heating will vary depending on the desired result.

When the protective metal coating materials are characterized by spangles such as galvanized coatings, the liquid film coating may be contacted with a nucleating agent which promotes the formation of smaller crystal structures, i.e., microspangles. For example, commercial galvanizing processes exist in which the metal removed from the molten zinc is sprayed with finely-divided zinc to provide nucleation sites.

The protective metal coating material, when contacting the rolls in accordance with this invention, is often at a temperature at which the protective metal coating material has begun to solidify. In some instances, the protective metal coating material will be semi-solid or in the solid, but plastic state, and will be capable of transferring protective metal coating material to an iron surface upon contact.

At least the portion of the lateral surface of the roll that is to contact the coated metal substrate is a refractory oxide having a relatively low thermal conductivity such as alumina, magnesia, zirconia, chromia, titania, silica, and the like and mixtures thereof. The preferred oxides exhibit a good thermal shock resistance. The refractory oxide often exhibits a thermal conductivity at 100° C. of less than about 0.1, preferably less than about 0.01, cal/(sec×cm×°C.), and frequently has a coefficient of thermal expansion of less than about $1\times10^{-5}$ per °C. Zirconia surfaces are often desirable because of the combination of mechanical strength, shock resistance, and low thermal conductivity. Most preferably, the surface is an yttria stabilized zirconia, i.e., zirconia containing about 6 to 10, say, about 8, weight percent yttria.

THE DRAWINGS

FIG. 2 is a schematic depiction of a tower roll in accordance with this invention.

FIG. 3 is a schematic depiction of a break-away section of the surface of a tower roll in accordance with this invention.

Figure 1:
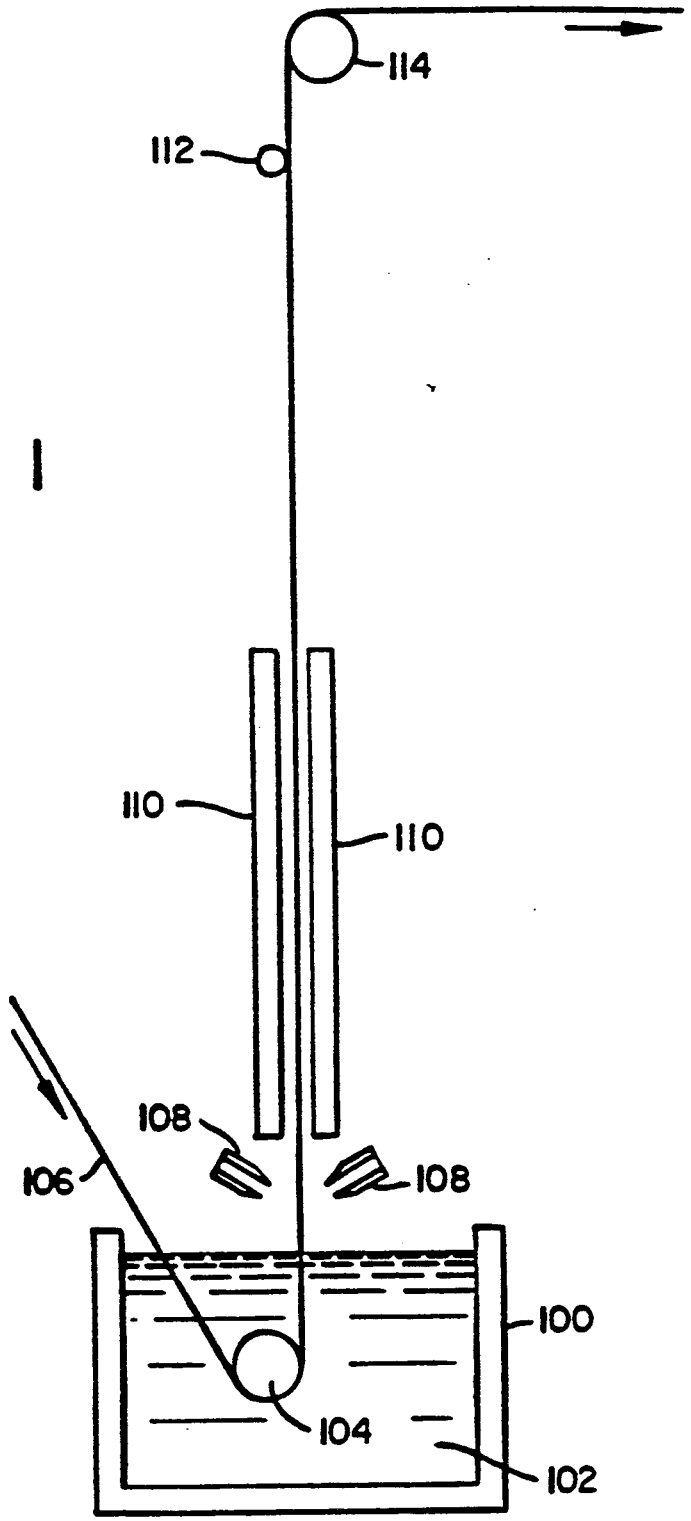
FIG. 1 is a schematic depiction of a cross-section of a hot-dip galvanizing apparatus having a galvannealing section and a tower roll in accordance with the invention.

With reference to FIG. 1, vessel 100 is externally heated and contains molten zinc 102. Roll 104 is positioned below the surface of the molten zinc 102 and is adapted to receive sheet metal 106. Generally the sheet metal has been pretreated to facilitate the galvanizing process. These pretreatment processes include annealing, chemical cleaning (e.g., with sulfuric acid), flame cleaning or combinations thereof.

The sheet metal 106 passes underneath roll 104 and is directed vertically from vessel 100. Above vessel 100 and on both sides of the sheet metal are air knives 108 which serve to remove excess molten zinc from the sheet metal.

The sheet metal 106 may then passes through a galvannealing unit 110. The galvannealing unit may be gas fired or electrically heated to a temperature sufficient to enable a zinc and iron alloy to form. This alloy provides a matte finish rather than macrospangling associated with zinc coatings. This zinc and iron alloy generally forms as a solid. The sheet metal 106 may then contact a guide roll 112 and then tower roll 114 where it is redirected horizontally and is typically fed into a cooling tower section (not depicted) of the mill. The cooling tower section may contain a number of rolls for supporting the sheet metal and moving the sheet metal to further processing. Although the zinc and iron alloy may be a solid, it can still be capable of being transferred.

With reference to FIG. 2, a tower roll 200 is generally shown. The tower roll has lateral surface 202, annular support structure 204, and spokes 206 which terminate at drive shaft 208. Drive shaft 208 may be adapted for mechanical communication with a motor for the purposes of rotating the drive roll at a desired speed to move the sheet metal. In some mills, however, the tower roll is not driven.

FIG. 3 illustrates an embodiment of the invention wherein the refractory oxide at the lateral surface of the tower roll is provided as an overlay or coating 302 over an intermediate overlay or coating 304 which improves the bonding and thermal shock resistance of the refractory oxide overlay on the tower roll. The intermediate overlay is shown as being bonded to a metal substructure 306 which can provide the form of the tower roll 200 as shown in FIG. 2.

Figure 4:
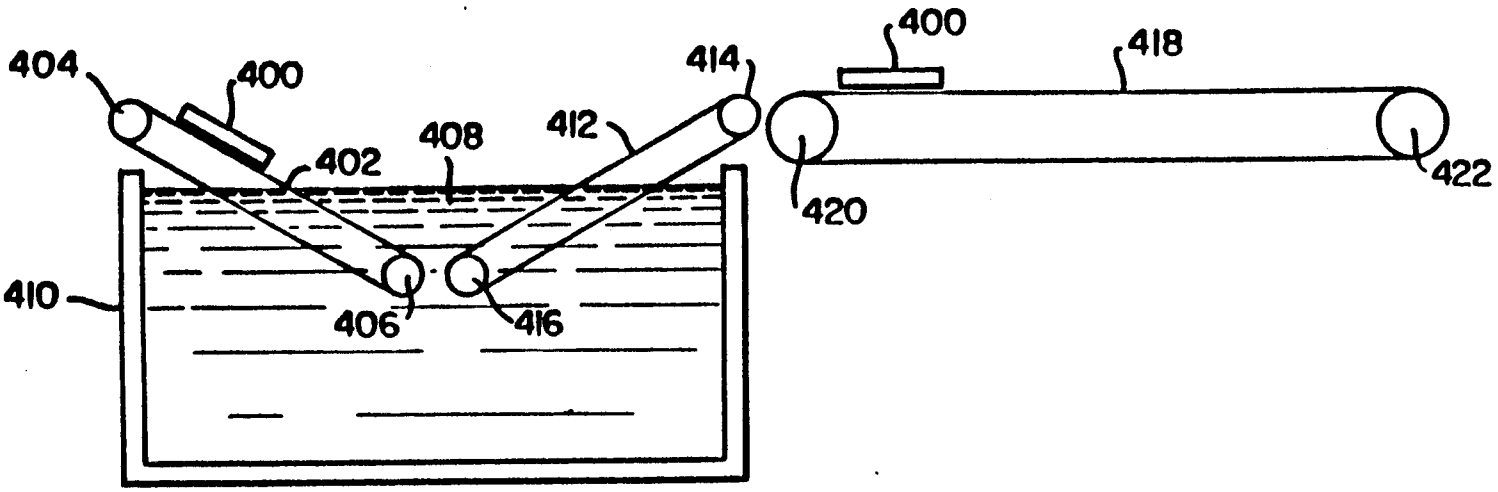
FIG. 4 is a schematic depiction of a horizontal galvanizing mill using a conveyor in accordance with this invention.

With reference to FIG. 4, iron-based articles 400 are transported by conveyor 402 having drive roller 404 and end roller 406 into molten zinc 408 contained in vessel 410. Articles are removed from vessel 410 by conveyor 412 having drive roller 414 and end roller 416. Both conveyors 402 and 412 are constructed of steel mesh. Articles 400 are then passed to conveyor 418 having a loose interlocking, wire mesh structure as depicted in the inset. The conveyor is fabricated of steel having a refractory oxide overlay. Conveyor 418 is powered by drive rolls 420 and 422.

OVERLAYS

The rolls in accordance with this invention preferably have an overlay of a refractory oxide material and have a mechanically strong and relatively inexpensive substructure, e.g., an iron or steel substructure. The refractory oxide overlay need not be thick in order to obtain the benefits of the invention. Often the thickness of the overlay is about 25 to 700, say, about 50 to 500, microns.

The overlay may be applied in any convenient manner and commercial services exist for applying refractory oxide overlays. The refractory oxide is typically applied through the use of a thermal spray process such as the plasma or detonation gun techniques. The refractory oxide, when applied by the plasma process, is typically provided in the form of a finely divided powder, e.g., in the range of about 5 to 100 microns in average particle size. The application of the refractory oxide with the plasma process is desirably sufficient to provide a coating density of at least about 80 percent, and often at least about 85 to 88 percent. The density is achieved by adjusting the gas flow, gas composition, amperage, voltage, torch to work distance and the like as is commonly practiced in the industry. The specific parameters that are used will vary with the design of the plasma torch used for the deposition.

Although plasma spray techniques such as disclosed in U.S. Pat. Nos. 2,858,411 and 3,016,447 and detonation gun techniques such as disclosed in U.S. Pat. Nos. 2,714,563 and 2,950,867 have been mentioned as possible methods of deposition of the overlays, it should be recognized that other thermal spray techniques can be used as well. These include the so-called "high velocity" plasma and "hypersonic" combustion spray processes as well as various flame spray processes. These and similar techniques are part of the "thermal spray" family of deposition technologies. Other technologies such as physical vapor deposition or chemical vapor deposition may also be applicable.

The oxide overlay may or may not have an undercoating. Undercoatings, for instance, composed of nickel, iron or cobalt based alloy with resistance to oxidation, can often provide enhanced bond strength and improved thermal shock resistance. Particularly useful undercoating materials include nickel-aluminum or nickel-chromium alloys and the MCrAl and MCrAlY alloys in which M is nickel, cobalt, iron, or any combination thereof. Alternative undercoats that may be used consist of a mixture of metals and oxides, or graded structures that consist of a first layer of pure metal with continuous or discontinuous additions of oxide with increasing volume fraction of oxide toward the outer surface.

The undercoatings can also be applied using suitable processes, e.g., the thermal spray process such as the detonation gun and plasma techniques. The undercoating, when used, frequently has a thickness of at least 20 microns, e.g., between about 20 to 500, say, about 50 to 250, microns.

When an undercoat is used, it is preferred that it have sufficient roughness to enhance the bonding to the refractory oxide overlay. Regardless of whether the steel superstructure is to be undercoated its surface should be cleaned and preferably roughened, e.g., by grit blasting.

Once the refractory oxide is applied, it is generally desired to finish the surface to produce a smooth surface. This finishing can be accomplished by any suitable means such as grinding, belt sanding, honing, and the like. A surface finish of less than 20 microinches rms is preferred.

The following examples are provided to further illustrate the invention and are not intended to be in limitation thereof.

EXAMPLE 1 (COMPARATIVE)

A tower roll having a diameter of 60 inches (1.524 meters) with an 84 inch (2.134 meters) wide lateral surface and constructed with steel was overlayed (coated) to a thickness of 75 to 100 microns with a chrome carbide-nichrome overlay [$Cr_3C_2$+20(Ni−20Cr)] (prefix numbers refer to weight percent) applied using a detonation gun. The overlay was finished to 6 to 10 microinches rms. The tower roll was used in a galvanizing mill having a galvannealing unit and is similar to that depicted in FIG. 1. The distance between the molten zinc surface in the hot-dip vessel to the tower roll was about 30 meters and the distance from the top of the galvannealing unit and the tower roll was about 18 meters. The galvannealing unit was about 3 meters above the molten zinc surface. Only ambient cooling was provided between the top of the galvannealing unit and the tower roll. The galvannealing unit was not being operated over the entire duration of the test using this tower roll. Rather, over some periods of time, the mill was producing the standard spangled product. After nine days pickup was visible on the entire roll face in the form of pinhead size zinc spots with smeared tails in the direction of strip travel. After an additional three days of operation, massive buildup on the roll had occurred. Attempts were made to remove the buildup using 120 grit aluminum oxide sandpaper with very little success. The roll face temperature was measured during operation and found to be about 980° F. The roll was removed from service after about 39 days of operation. This illustrates the unsatisfactory performance of a state-of-the-art conventional overlay.

EXAMPLE 2

A steel roll having a 5 inch (12.7 cm.) diameter and an 84 inch (2.134 meters) lateral surface was undercoated with a plasma deposited MCrAlY coating having a composition of 32Ni-21Cr-8Al-0.5Y-balance Co with a thickness of about 75 microns. An overlay of an yttria-stabilized zirconia ($ZrO_2$-$8Y_2O_3$) was deposited by plasma to a thickness of 325 microns. The surface was finished to less than 20 microinches rms.

The roll was placed in the same facility as the tower roll in Example 1 at a position immediately below the tower roll. The roll was held against the sheet metal at a force comparable to or slightly higher than the force of the sheet metal on the tower roll. When first placing the roll into service, a tendency to pick-up zinc on the surface was observed. Even so, the transferred material did not appear to agglomerate to such a size that the quality of the finish on the metal contacting the surface of the roll was deleteriously affected. After further use of the roll, zinc no longer appeared to collect on the roll, and in fact, that zinc which transferred to the surface of the roll seemed to be lost. After a period of six months the roll was removed from service with no evidence of zinc pickup and little or no wear on the roll face. There was some grooving at the edge of the strip because the roll had been performing so successfully it was used to guide this strip across the tower roll by applying more pressure to one edge than the other. During this period of service a variety of strip product was run, including standard-spangled and galvannealed.

What is claimed is:

1. An apparatus for coating an iron-based substrate with a coating of a protective zinc metal alloy or compound which comprises;

(a) a vessel means containing a molten protective metal of a zinc alloy or compound;

(b) means for immersing an iron-based substrate into the molten protective metal to coat the iron-based substrate with the protective metal coating, (c) means disposed in the atmosphere outside of said vessel means for directing the iron-based substrate from the molten protective metal, the directing means comprising a roll having a metal understructure and a coating of yttria stabilized zirconia for providing a contact surface which engages the protective zinc metal coating when the protective metal is still in a plastic state, and wherein said coating of zirconia has a thickness between 20 and 500 microns and a surface finish of no more than about 20 microinches rms for preventing adhesion to the protective metal.

2. The apparatus of claim 1, wherein the thickness of said zirconia coating is between about 50 and about 500 microns.

3. The apparatus of claim 1 wherein an undercoat layer is immediately below said zirconia coating.

4. The apparatus of claim 3 wherein the undercoat layer comprises an alloy selected from the group consisting of nickel-based alloy, iron-based alloy, and cobalt-based alloy.

5. The apparatus of claim 3 wherein the undercoat layer comprises MCrAl, wherein M is selected from the group consisting of nickel, iron, and cobalt.

6. The apparatus of claim 5 wherein the undercoat layer additionally comprises yttria.

7. The apparatus of claim 3 wherein the undercoat layer comprises nickel and aluminum.

8. The apparatus of claim 3 wherein the undercoat layer comprises nickel and chromium.

9. The apparatus of claim 3 wherein the thickness of the undercoat layer is between about 20 microns, and about 500 microns.

10. The apparatus of claim 3 wherein the thickness of the undercoat layer is between about 50 microns, and about 250 microns.

11. The apparatus of claim 1 further comprising a heating zone adapted to receive the protective-metal-coated substrate and adapted to maintain the protective metal coated upon the iron-based substrate at an elevated temperature sufficient to form an alloy of iron and the protective metal.

12. The apparatus of claim 11 wherein the directing means is placed after the heating zone.

13. The apparatus of claim 1 wherein the protective metal is selected from the group consisting of zinc, aluminum, aluminum-zinc alloy, aluminum-silicon alloy, tin, terne metal, copper, and copper alloy.

14. The apparatus of claim 1 wherein the protective metal is selected from the group consisting of zinc, aluminum, and aluminum-zinc alloy.

15. A process for coating an iron-based substrate with a protective metal coating of a zinc alloy or compound from a liquid bath of such protective metal which comprises;

(a) immersing a iron-based substrate into a molten protective metal bath of said zinc metal; and (b) directing the iron-based substrate from the molten protective metal bath over a roll disposed in the open atmosphere outside of the molten protective metal bath with the roll having a metal understructure and a coating of yttria stabilized zirconia for providing a contact surface which contacts the protective-metal-coated substrate when the protective metal is still in a plastic state, with said coating of zirconia having a thickness between 20 and 500 microns and a surface finish of no more than about 20 microinches rms for preventing adhesion to the protective metal.

16. The process of claim 15 wherein the protective metal is selected from the group consisting of zinc, aluminum, aluminum-zinc alloy, aluminum-silicon alloy, tin, terne metal, copper, and copper alloy.

17. The process of claim 15 wherein the thickness of the refractory oxide coating is between about 50 and about 500 microns.

18. The process of claim 15 wherein the protective metal is selected from the group consisting of zinc, aluminum, and aluminum-zinc alloy.

19. The process of claim 15 wherein an undercoat is immediately below the coating of zirconia.

20. The process of claim 19 wherein the undercoat layer comprises an alloy selected from the group consisting of nickel-based alloy, iron-based alloy, and cobalt-based alloy.

21. The process of claim 19 wherein the undercoat layer comprises MCrAl, wherein M is selected from the group consisting of nickel, iron, and cobalt.

22. The process of claim 21 wherein the undercoat layer additionally comprises yttria.

23. The process of claim 19 wherein the undercoat layer comprises nickel and aluminum.

24. The process of claim 19 wherein the undercoat layer comprises nickel and chromium.

25. The process of claim 19 wherein the thickness of the undercoat layer is between about 20 microns, and about 500 microns.

26. The process of claim 19 wherein the thickness of the undercoat layer is between about 50 microns, and about 250 microns.

27. The process of claim 15 further comprising a heating zone adapted to receive the protective-metal-coated substrate and adapted to maintain the protective metal coated upon the iron-based substrate at an elevated temperature sufficient to form an alloy of iron and the protective metal.

28. The process of claim 27 wherein the directing means is placed after the heating zone.

* * * * *